US006212813B1

(12) United States Patent
Luna et al.

(10) Patent No.: US 6,212,813 B1
(45) **Date of Patent: *Apr. 10, 2001**

(54) QUICK-RELEASE GUN LOCK

(76) Inventors: Cruz Luna, 155 N. Dillon Ave., San Jacinto, CA (US) 92583; Larry Ross, P.O. Box 1429, Idyllwild, CA (US) 92599

( * ) Notice: Subject to any disclaimer, the term of this patent is extended or adjusted under 35 U.S.C. 154(b) by 0 days.

This patent is subject to a terminal disclaimer.

(21) Appl. No.: 09/223,067

(22) Filed: Dec. 29, 1998

Related U.S. Application Data

(63) Continuation-in-part of application No. 08/960,704, filed on Oct. 30, 1997, now Pat. No. 5,950,344.

(51) Int. Cl.[7] ..... F41A 17/00
(52) U.S. Cl. ..... 42/70.11
(58) Field of Search ..... 42/70.11

(56) References Cited

U.S. PATENT DOCUMENTS

| | | | | |
|---|---|---|---|---|
| 3,444,639 | * | 5/1969 | Rockwood | 42/70.11 |
| 5,048,211 | * | 9/1991 | Hepp | 42/70.11 |
| 5,315,778 | * | 5/1994 | Wolford | 42/70.11 |
| 5,450,685 | * | 9/1995 | Peterson | 42/70.11 |
| 5,664,358 | * | 9/1997 | Haber et al. | 42/70.11 |

* cited by examiner

*Primary Examiner*—Charles T. Jordan
*Assistant Examiner*—Denise J Buckley
(74) *Attorney, Agent, or Firm*—Steins & Associates

(57) ABSTRACT

A Quick-release Gun Lock is disclosed. The gun lock comprises a base that cooperates with the gun's extractor, a pliable and expandable portion attached to the base for expanding to create an interference fit with the gun's bore, and a compression shaft that, when rotated, will force the expandable portion outwardly to create the interference fit. The device may further include a cam hub that interacts with the compression shaft to provide the desired interference fit with less than one rotation.

14 Claims, 10 Drawing Sheets

QUICK-RELEASE GUN LOCK

This application is a continuation-in-part of U.S. patent application Ser. No. 08/960,704 filed Oct. 30, 1997, now U.S. Pat. No. 5,950,344.

BACKGROUND OF THE INVENTION

1. Field of the Invention

This invention relates generally to tamper-proof locks for firearms and, more specifically, to a Quick-release Gun Lock.

2. Description of Related Art

Guns and other firearms have been in use by society for protection and recreation for centuries. In recent years, with escalating crime levels, and particularly in attacks at the home, people have contemplated arming themselves. To have a weapon in the home can provide a feeling of security for many people. Historically, there have been two problems with keeping a firearm in the home: (1) preventing children from getting injured while playing with a loaded gun, and (2) preventing an intruder from getting to the weapon first and using it against the victims. As a result, even if a person does keep a gun in the home, it is usually not loaded. An unloaded gun can actually be more dangerous than a loaded one, since it can usually only be a deadly bluff to the future invader. What is needed is a device that permits a gun to be loaded and ready for use, while still preventing injury to children, as well as keeping an intruder from using the gun against the victims.

Semi-automatic weapons have become particularly popular for self-defense purposes because they can fire quicker and they hold more rounds than a revolver. While other prior devices have attempted to solve the gun safety problem for revolvers or rifles, none has been effective for semi-automatic weapons. FIGS. 1 through 5 will introduce the reader to the problems with locking semi-automatic pistols.

FIG. 1 depicts a conventional semi-automatic pistol 10. The pistol 10 comprises two major structures: the handle portion 12 and the slide 14. The slide 14 is permitted to slide along the handle portion 12 during the operation of the pistol 10.

FIG. 2 depicts the pistol 10 with the slide 14 in the recoil position, such as is the case when the slide 14 recoils immediately after a shot is fired. As can be seen, the slide 14 has traveled towards the left with respect to the handle portion 12. The barrel 16 is exposed in this position, and the spent shell exit 18 is open to the chamber (see FIG. 3). If a shot had just been fired, the spent shell casing would have been drawn out of the chamber by the extractor (see FIG. 3), which is attached to the slide 14. The extractor (see FIG. 3) also ejects the spent shell casing out of the chamber through the spent shell exit 18.

FIG. 3 is a partial cutaway side view of the typical semi-automatic pistol 10, depicting some of the inner workings as pertinent to the present invention. The slide 14 is in the recoil position in this view to depict what happens immediately after the spent shell casing has been ejected. The position shown could also be the result of manually cocking the pistol by grasping the slide 14 with the hand and pushing it to the left with respect to the handle portion 12.

When the slide 14 is cocked, a round 20 is dispensed by the magazine 22 into the vicinity of the chamber 24. The chamber 24 is the end of the barrel 16 from where rounds 20 are fired. The chamber 24 may be of larger diameter than the center of the barrel 16 (i.e. the bore 26), or the bore 26 may be the same diameter from the tip of the barrel 16 to the chamber 24.

FIG. 4 depicts the pistol 10 once the slide 14 has returned to the uncocked or ready position. When the slide 14 travels forwardly, it forces the round 20 into the chamber 24; the mechanism that accomplishes this is not pertinent to this discussion, and is therefore not shown. If one can imagine that the bullet has been fired out through the bore 26, and that now the round 20 is actually a spent shell casing, we can proceed to understanding the functioning of the pistol 10.

While a round is in the chamber 24, it is engaged by the extractor 28. As described above in connection with FIGS. 1 and 2, when a shot is fired, the slide 14 would recoil by traveling to the left. Since the extractor 28 is attached to, and travels with, the slide 14, when the slide 14 recoils, the extractor 28 will remove the spent shell casing (imagine as the round 20) by pulling it backward and out of the chamber 24. Once free from the chamber 24, the spent shell casing (imagine as the round 20) will be aligned with the spent casing exit (see FIG. 1), through which it is ejected through, also by the extractor 28.

FIG. 5 further shows how the extraction process operates. FIG. 5 is a partial cutaway top view of the pertinent components of the pistol. As can be seen, the extractor 28 is a spring-loaded "finger" that grabs onto the groove 30 that is located at the bottom of the spent shell casing (imagine as the round 20).

Rockwood, U.S. Pat. No. 3,382,596, discloses a "Safety Plug for Firearm Chamber" that is, essentially, a two-piece unit that fits into the chamber and thereafter prevents a round from being loaded. There are at least three problems with the Rockwood device as it applies to semi-automatic pistols. First, the device would be easily removed from the pistol by an intruder or child, by simply jamming a stick into the barrel and poking the device out through the spent casing exit. Second, the device cannot be hidden from the potential intruder in order to prevent its removal. All that the intruder has to do is to cock the slide and look into the spent shell exit to see the device and therefore determine how to remove it. Third, there is no quick way to remove the two-piece Rockwood device. If the device is inserted with an interference fit, as described (see Column 3, line 3), it must be jammed out by a stick inserted into the barrel—this process could take more time than is available in an emergency situation. What is needed is a locking device for semi-automatic and automatic pistols that is disguised while in use to prevent unauthorized users from removing it. The device should also be extremely quick and easy to remove in case of emergency.

Another device, the "Safety Device for Firearms" disclosed in S. Pula et al., U.S. Pat. No. 2,836,918, is unworkable for the semi-automatic or automatic weapon. The Pula device has at least three problems with its design. First, the design is extremely complicated, and therefore not cost-effective. In order for this device to gain wide-spread popularity, and therefore use and protection, it must be reliable but also fairly inexpensive. The Pula device is cost-prohibitive as designed. Second, the Pula device, like the Rockwood device, is difficult and slow to remove. Presumably, (although the removal process is not disclosed by Pula) the device is removed by unscrewing the plug 18, by engaging the tool 23 with either the front or rear kerf 20 and 21, respectively. The device is then poked or shaken out of the chamber. Again, the time to execute these steps may not be available. Third, the Pula device must be made from metal in order to provide the necessary durability to the expanded segments 17. The insertion of a metal device into the chamber that is then pressed outwardly into the bore walls, may actually mar the surface of the chamber and damage the gun. What is needed is a low-cost, reliable, quickly-removable gun lock that will not damage the inner workings of the gun.

SUMMARY OF THE INVENTION

In light of the aforementioned problems associated with the prior devices, it is an object of the present invention to provide a Quick-release Gun Lock. It is a further object that the gun lock the chambering and firing actions of automatic weapons, while still permitting the triggering action to work. It is a still further object that the locking device be easily installed through the gun's spent shell exit, and that it be quickly released via a tool inserted into the bore, and ejected via the spent shell exit. It is a still further object that the device be concealed from view to prevent tampering. It is yet another object that the device be manufactured from low-cost designs and materials and that the device not cause damage to the inner workings of the weapon.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Quick-release Gun Lock.

Figure 1:
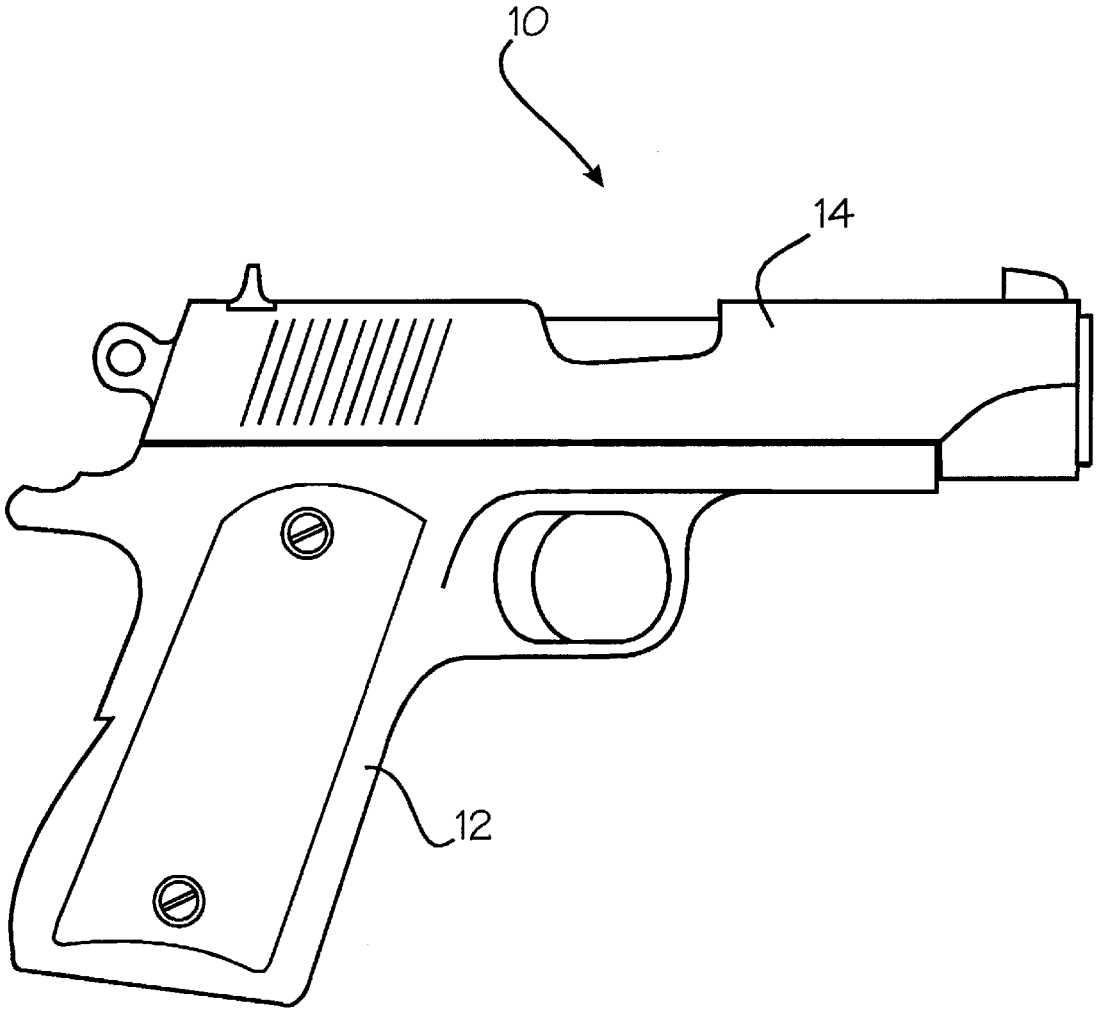
FIG. 1 is a side view of a typical semi-automatic pistol
Figure 2:
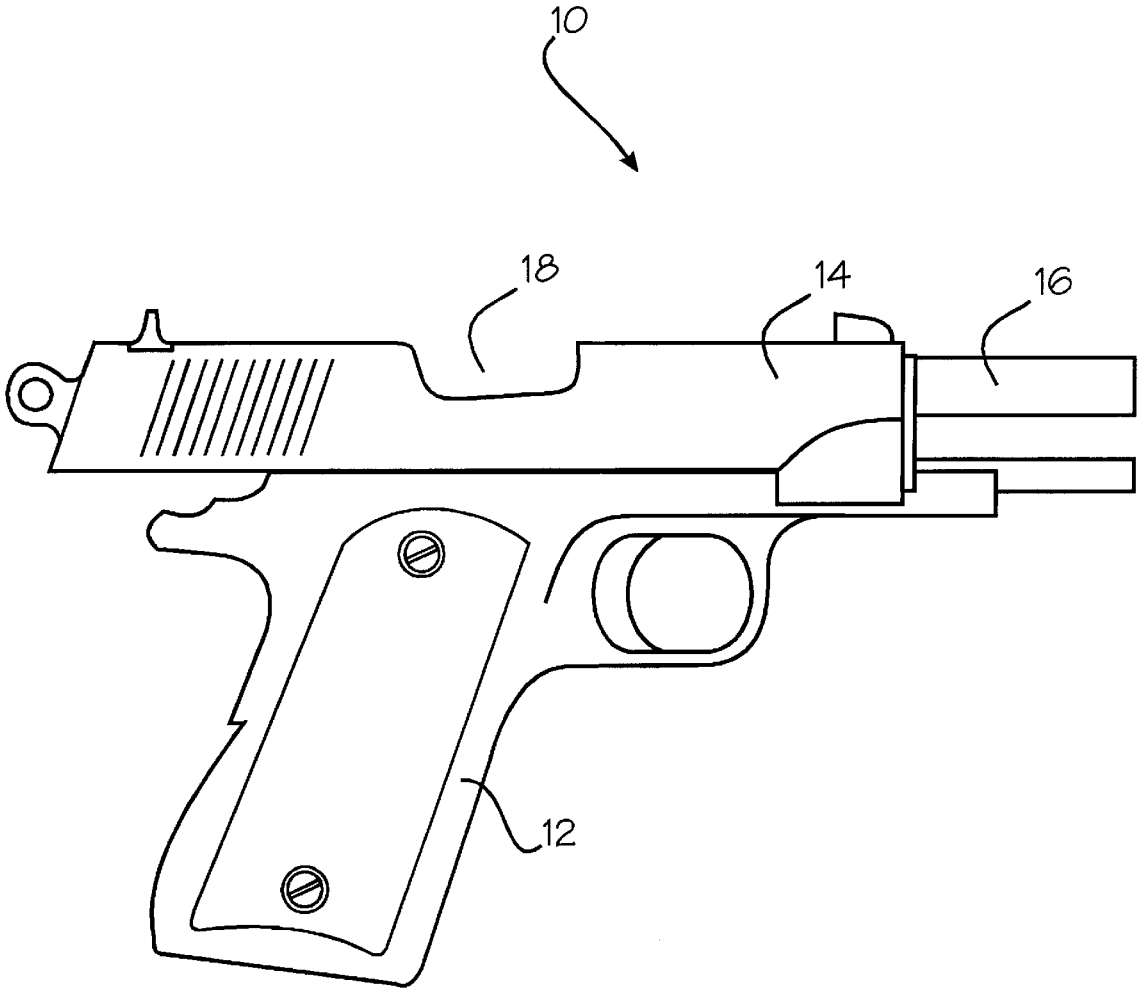
FIG. 2 is a side view of the pistol of FIG. 1, with the slide in the recoiled position.
Figure 3:
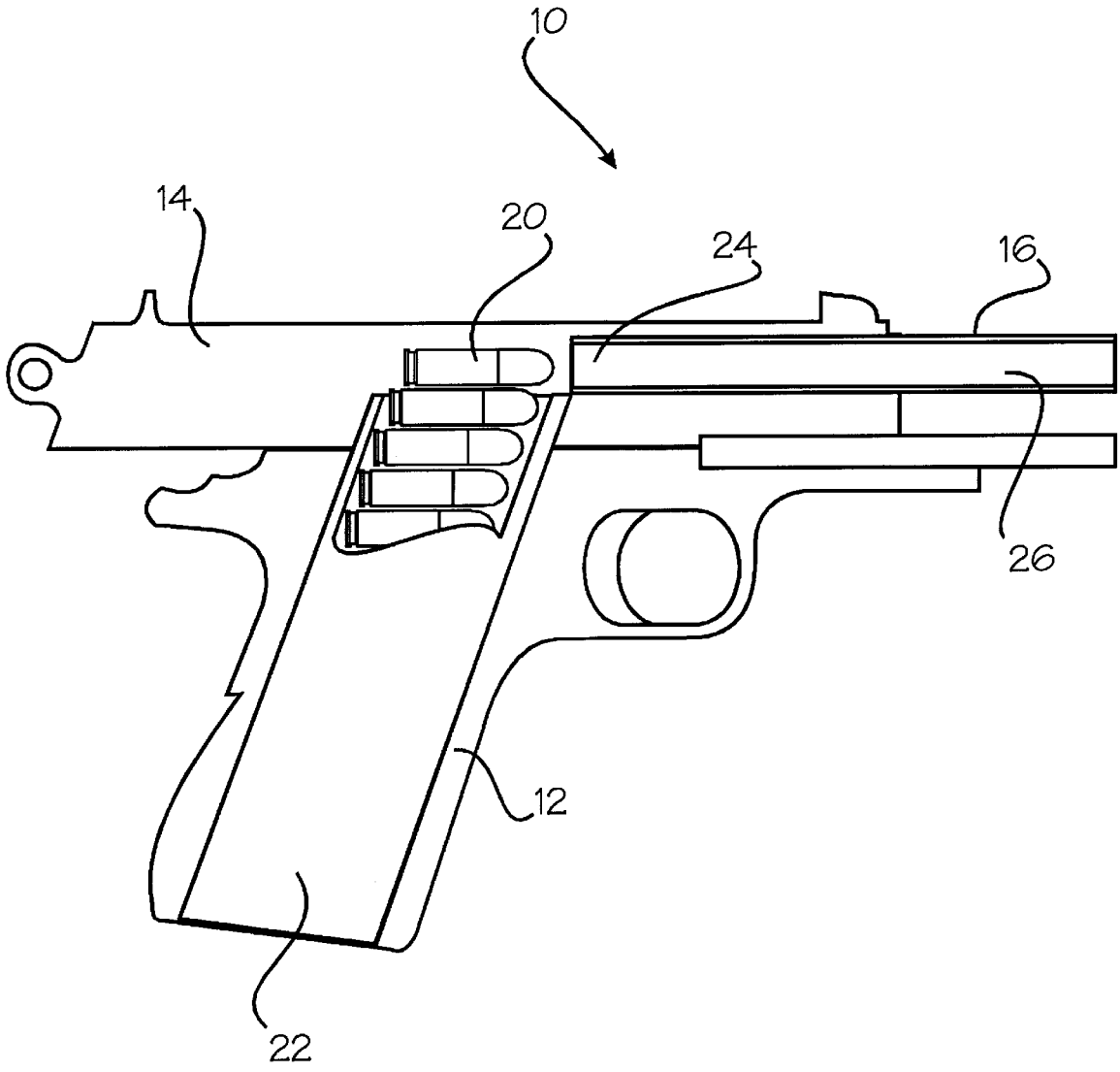
FIG. 3 is a cutaway side view of the pistol of FIG. 2, with the slide in the recoiled position.
Figure 4:
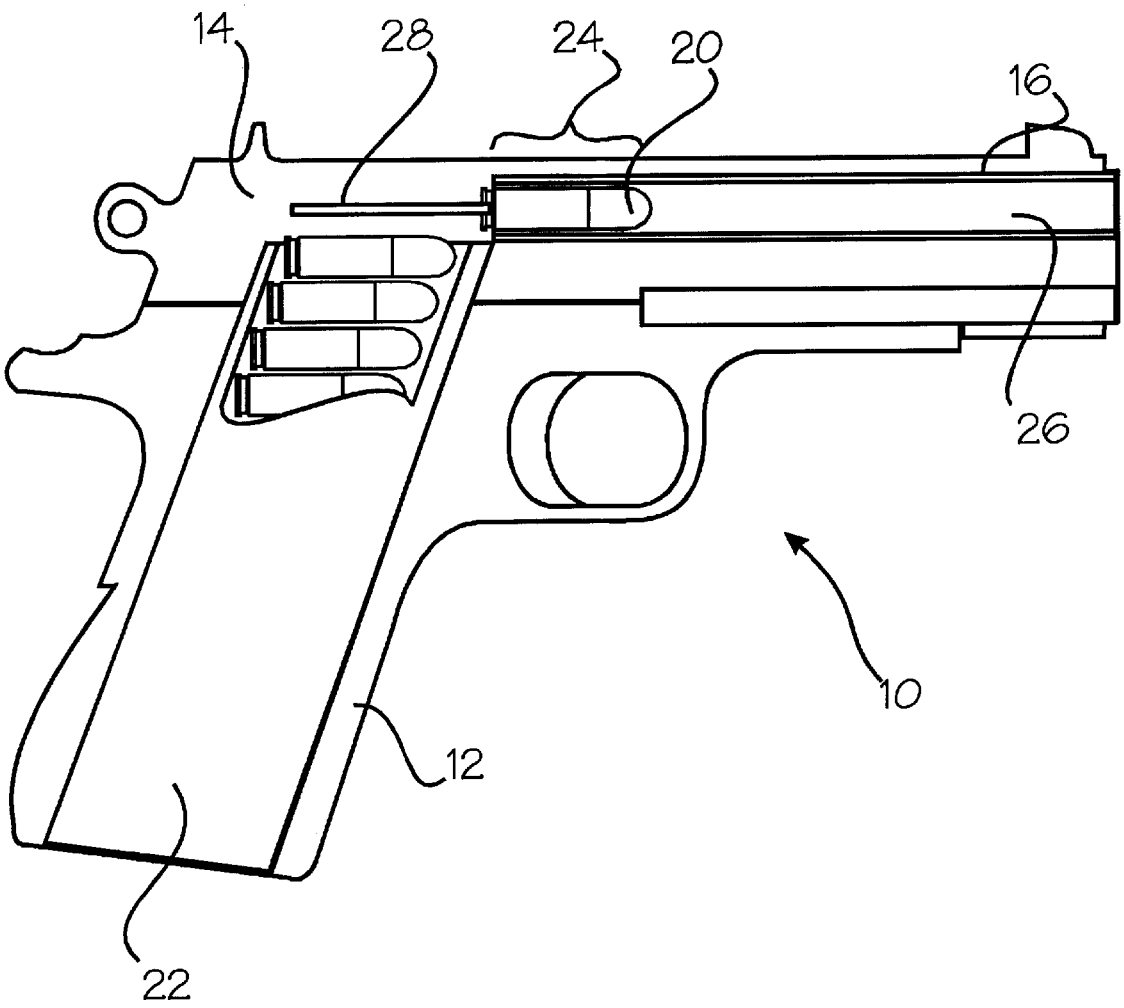
FIG. 4 is a cutaway side view the pistol of FIG. 1, with the slide in the extended position.
Figure 5:
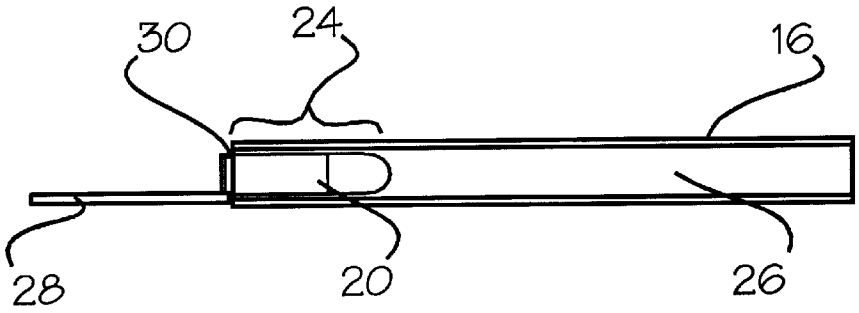
FIG. 5 is a cutaway top view of the barrel of the pistol of FIG. 4.
Figure 6:
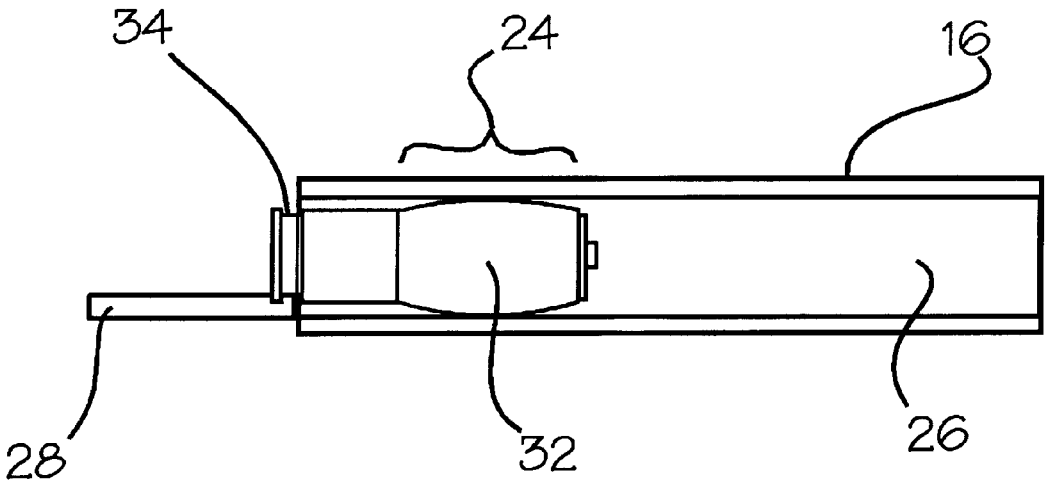
FIG. 6 is a partial cutaway top view of the barrel of FIG. 5, depicting a preferred locking device of the present invention.

The present invention can best be understood by initial consideration of FIG. 6. FIG. 6 is a partial cutaway top view of a preferred locking device 32 of the present invention when installed in a typical chamber 24 of a semi-automatic or automatic weapon. As can be seen, the locking device 32 is expanded against the walls of the bore 26, like the Pula device, but the present invention has another benefit. There is a groove 34 that is formed in the locking device 32 that is very similar to the groove 30 found on a conventional round 20 (see FIGS. 1–5). If one returns to FIG. 4, it can be appreciated that if the round 20 was "stuck" in the chamber and prevented from being removed, the extractor 28 could not pull the round 20 out of the chamber 24, and the slide 14 (which is attached to the extractor 28) could not be cocked or recoiled. Since the slide 14 could not be cocked, it would be impossible to look through the spent shell exit (see FIGS. 1 and 2) to determine what was preventing the slide (see FIGS. 1 and 2) from moving. Since the device 32 could not be viewed, it is very likely that an unauthorized user would not be able to determine how to load the gun or be able to remove the locking device 32. This is a significant benefit over the prior devices.

Another critical advantage must be appreciated. In order to remove the locking device 32, one need only release the force pressing against the walls of the chamber 24, and then cock the slide. When the slide is cocked now, the extractor 28 will pull the locking device 32 out of the chamber 24 via the groove 34, and the locking device 32 will be ejected through the spent casing exit (see FIG. 2), just like a spent casing. As this is done, a new round will be loaded into the chamber 24 when the slide is released. This process is extremely quick, with no wasted movement.

Figure 7:
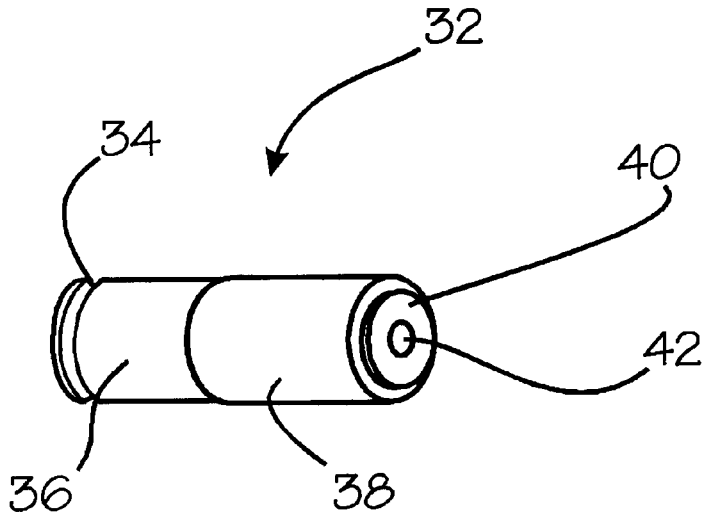
FIG. 7 is a perspective view of the preferred embodiment of the present invention of FIG. 6.

FIG. 7 gives further detail of the present invention. FIG. 7 is a perspective view of the preferred locking device 32 of FIG. 6. This preferred embodiment comprises a base 36, preferably of brass or aluminum or other material that is strong, yet will not damage the gun by its use. The groove 34 is cut in the base 36, much the same as in a round of ammunition. Attached to the base 36 is an expandable portion 38, made preferably of rubber or other pliable material that will deform under pressure, and then return to its original configuration once the pressure is released. At the end of the expandable portion 38 is a compression disc 40 and a socket 42. The operation of the device 32 is best understood by now considering FIG. 8.

Figure 8A:
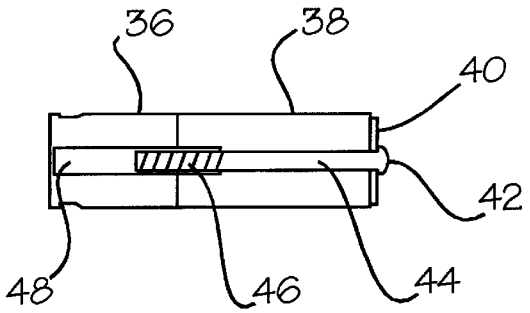
FIGS. 8A and 8B are a pair of cutaway side views of the preferred embodiment of the present invention of FIGS. 6 and 7.
Figure 8B:
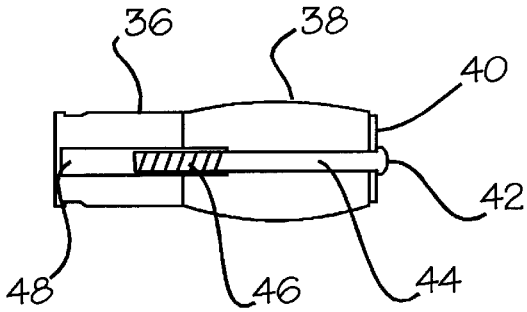

FIGS. 8A and 8B is a pair of partial cutaway side views of the locking device of FIG. 7. View "A" depicts the device in a relaxed or unexpanded condition, such as prior to locking the gun. View "B" depicts the device in an expanded condition, such as when the device is installed and locked inside the chamber of a gun (see FIG. 6).

The socket 42 is the tip of the compression shaft 44. The compression shaft 44 runs through a bore in the center of the expandable portion 38 and terminates in a threaded portion 46. The threaded portion 46 engages the threaded tube 48 that is formed within the base 36. As can be seen, therefore, one need merely to turn the socket 42, which will turn the compression shaft 44, thereby causing the threaded portion 46 to bore into the threaded tube 48, and causing the expandable portion 38 to be compressed by the compression disc 40. When compressed, the expandable portion 38 is configured to expand outwardly (such as into the walls of a firing chamber). When the compressing forces are removed, the expandable portion 38 will return to its original configuration, permitting the device to be removed quickly by simply cocking the slide.

The compression disc 49 may be made from conventional rigid materials, such as in a washer. The socket 42 could be keyed to accept only the owner's tool (inserted down the barrel of the weapon) to engage and disengage the device. The expandable portion 38 of this embodiment is preferably made from rubber or other material which will expand laterally when its ends are compressed, and then return to its original configuration once the compressive forces are removed. It must be appreciated that an expandable portion 38 made from rubber is a novel solution, since it is easy to machine to the proper dimensions to fit into the chamber (i.e. no tight manufacturing tolerances). The rubber also expands greatly under little or no compression, which means that a tight interference fit can be created by barely turning the compression shaft 44.

Figure 9:
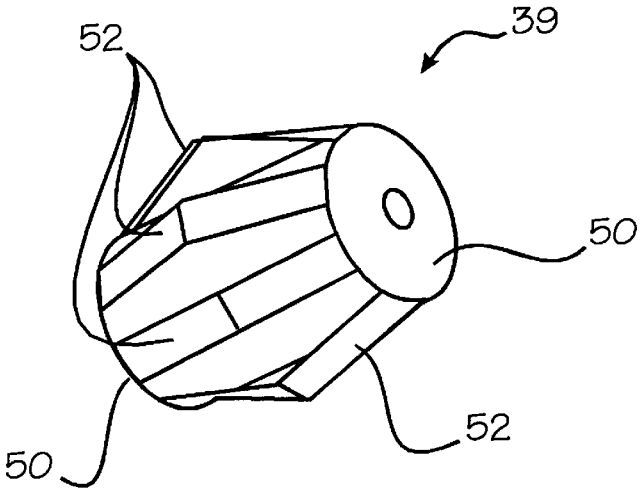
FIG. 9 is a perspective view of another preferred expandable portion.

FIG. 9 depicts an alternative expandable portion 39. As can be seen, this expandable portion 39 comprises a pair of ends 50 which are connected to each other by a plurality of fins 52. When the ends 50 are pressed towards one another, the fins 52 will be forced outwardly, just as with the aforementioned embodiment of the expandable portion 38. This expandable portion 39 might be preferred for some circumstances, however, will most likely result in higher manufacturing costs than the expandable portion 38.

Figure 10:
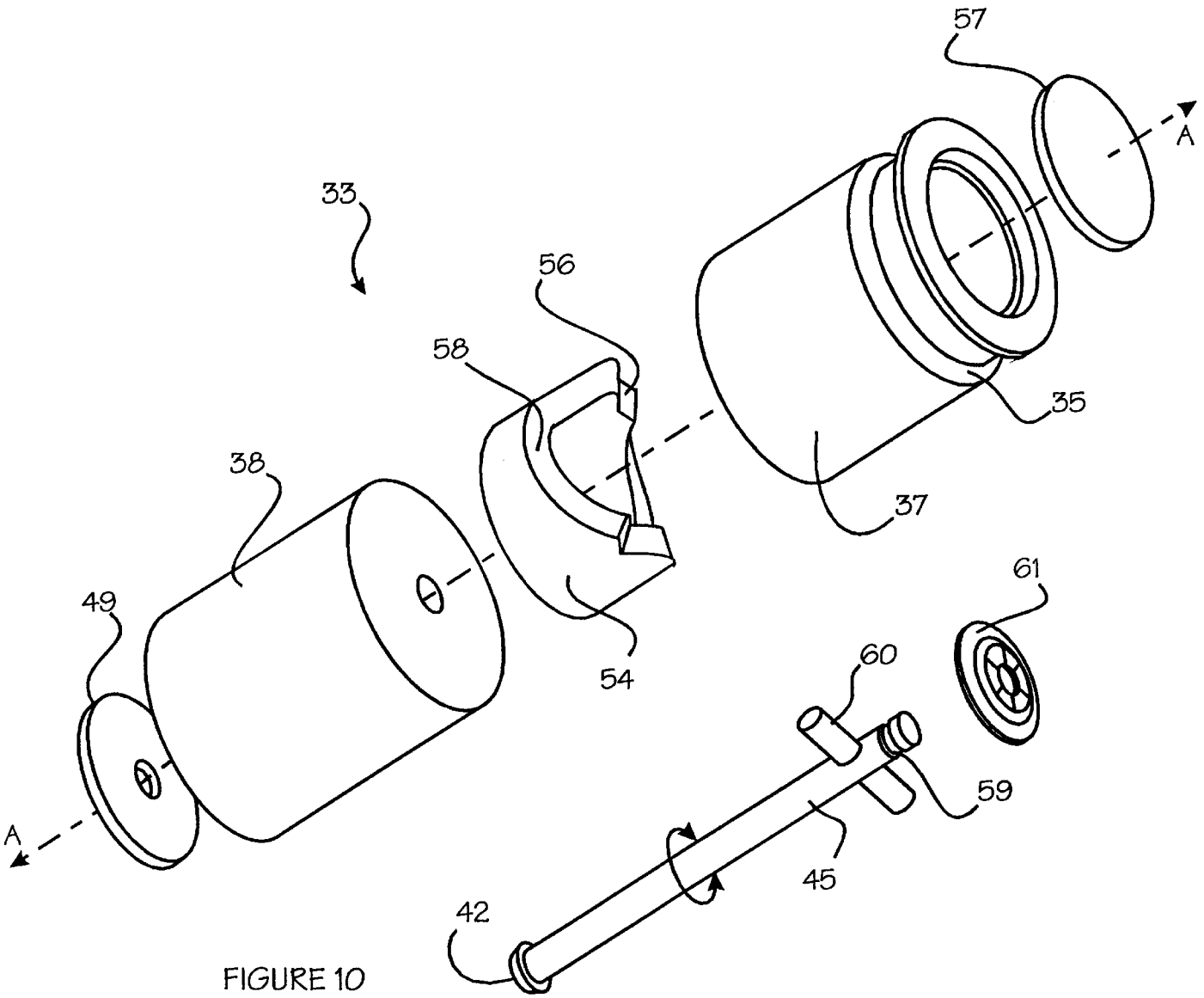
FIG. 10 is an exploded perspective view of another preferred embodiment of the present invention.

Now turning to FIG. 10, one might understand yet another embodiment of the present invention. FIG. 10 is an exploded perspective view of a preferred locking device 33. The device 33 comprises a base 37 that includes a groove 35 which is engageable to the extractor (see FIGS. 3–6). Also shown in this embodiment is a disc 57, preferably of plastic or other malleable material, inserted into the end of the base 37. The plastic disc 57 will permit the user to "dry-fire" the weapon once the locking device is installed without causing damage to the firing pin (not shown). Within the base 37 is a cam hub 54 that includes a shallow notch 56 and a deep notch 58. The cam hub 54 is attached to the base 37 to prevent rotational or lateral motion.

As with the previous embodiment of the present invention, there is an expandable portion 38 and a compression disc 40. The compression shaft 45 of the present embodiment has some differences. While it terminates in a conventional socket 42 at one end, it terminates in a follower member 60 at the other end. The follower member is configured to engage the shallow and deep notches 56 and 58, respectively, when the compression shaft is pressed axially and turned. As should be appreciated, only a ½ turn of the compression shaft 45 will result in engagement or disengagement of the compressive forces. At the end of the compression shaft 45, there may be a snap-washer 61 or the like to center and retain the compression shaft 45 within the apparatus. The snap-washer 61 or the like attaches to the compression shaft 45 by snapping into groove 59.

Figure 11:
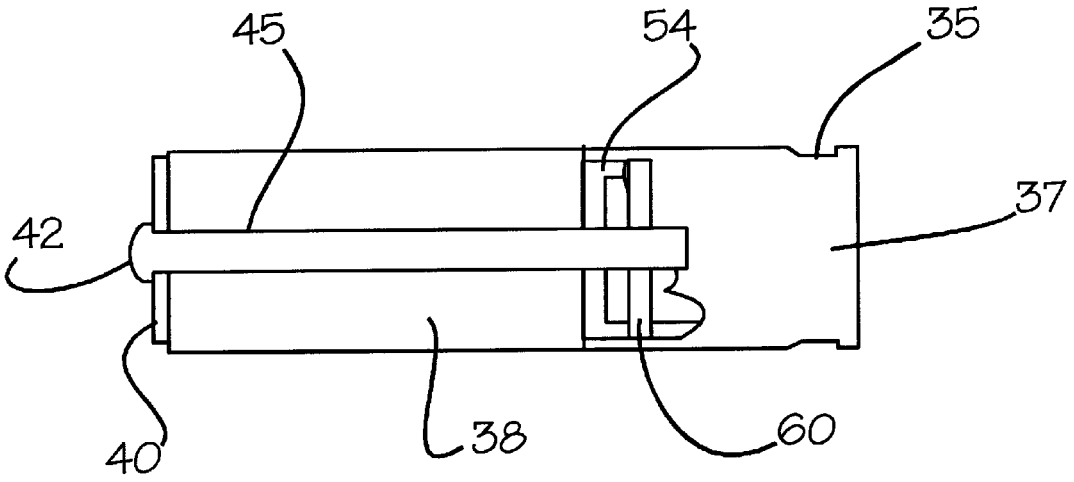
FIG. 11 is a cutaway side view of the preferred embodiment of the present invention of FIG. 9, depicted in an uncompressed state.
Figure 12:
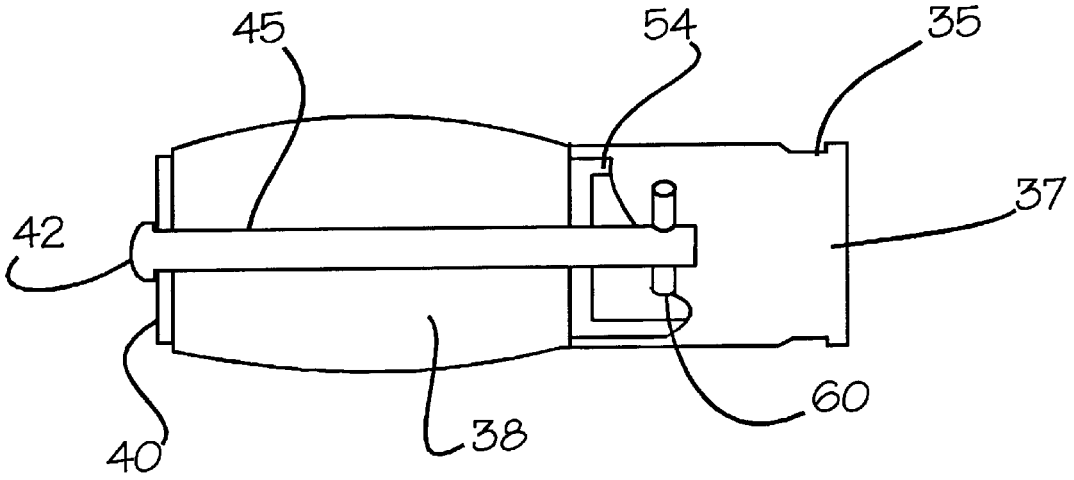
FIG. 12 is a cutaway side view of the preferred embodiment of the present invention of FIGS. 9 and 10, depicted in a compressed state.

FIGS. 11 and 12 depict the two operating configurations of this alternative embodiment of the present invention. FIG. 11 is a cutaway side view showing the locking device 33 in an uncompressed state. As can be seen, the compression shaft 45 has been rotated such that the follower member 60 has fallen into the deep notch (see FIG. 10) of the cam hub 54. In this position, no compressive force is exerted on the compression disc 40 and therefore none is exerted on the expandable portion 38.

FIG. 12 is a cutaway side view showing the locking device 33 in a compressed state. As can be seen, the compression shaft 45 has now been rotated such that the follower member 60 sits in the shallow notch (see FIG. 10). The user had to press down axially on the socket 42 before turning, and then turned the socket 42¼ of a turn and released the pressure. With the follower member 60 in the shallow notch, there is compressive force exerted on the compression disc 40 and expandable portion 38, causing the expandable portion 38 to expand. The user need only to press axially on the socket 42 and turn ¼ of a turn again to release the locking device. This is a significant benefit over the prior devices.

Other configurations and numbers of these notches is conceived but not listed here for the sake of brevity. It should be appreciated that the function of the cam hub 54 is to interact with the compression shaft 45 to provide positive stops to compress and release the expandable portion 38.

Figure 13:
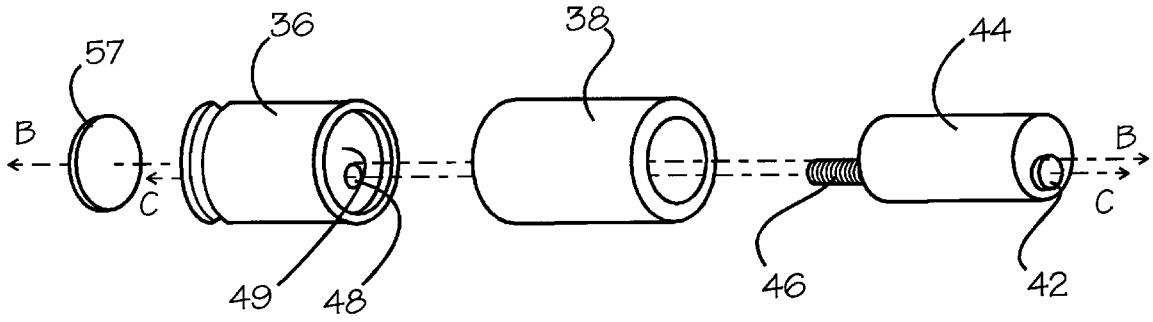
FIG. 13 is an exploded perspective view of another preferred embodiment of the present invention.
Figure 14A:
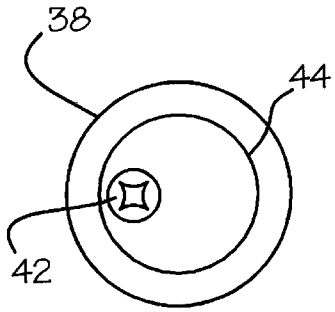
FIGS. 14A and 14B are a pair of top views of the preferred embodiment of the present invention of FIG. 13, depicting the relaxed (14A) and locked or compressed (14B) positions.
Figure 14B:
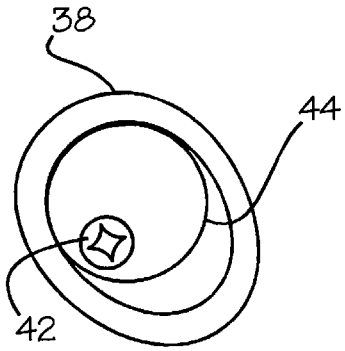

FIGS. 13 and 14 depict yet another preferred embodiment of the present invention. FIG. 13 is an exploded perspective view of this alternative embodiment. As with the embodiment of FIGS. 6–9, this embodiment includes a base 36, an expandable portion 38, and a compression shaft 44. What is unique here is the inclusion of the plastic cap 57, as well as the configuration of the compression shaft 44 and socket 42. As can be seen, the centerline B—B of the base 36, expandable portion 38 and compression shaft 44 is not the same as the centerline C—C of the socket 42 and threaded portion 46. When the socket 42 is turned, therefore, the compression shaft 44 will actually rotate away from centerline B—B, thereby forcing the expandable portion 38 outward. Furthermore, while not shown in these figures for the sake of brevity, it should be appreciated that it might be desirable to include a ratcheting or other means for retaining the compression shaft 44 in one place after it has been rotated. This means may be a variety of forms, including ribbed washers, notches in the base 36, or other features that would hold the compression shaft 44 from rotating, including a "stop" at the end of travel back towards the relaxed position (see FIG. 14A). FIGS. 14A and 14B clearly depict this novel relationship.

FIGS. 14A and 14B are a pair of top views of the preferred embodiment of the present invention of FIG. 13, depicting the locking device in relaxed (14A) and locked or compressed (14B) positions. As can be seen in FIG. 14B, rotating the socket 42 causes the compression shaft 44 to rotate away from center, and thereby presses the expandable portion 38 outwardly (and into the bore walls).

Figure 15:
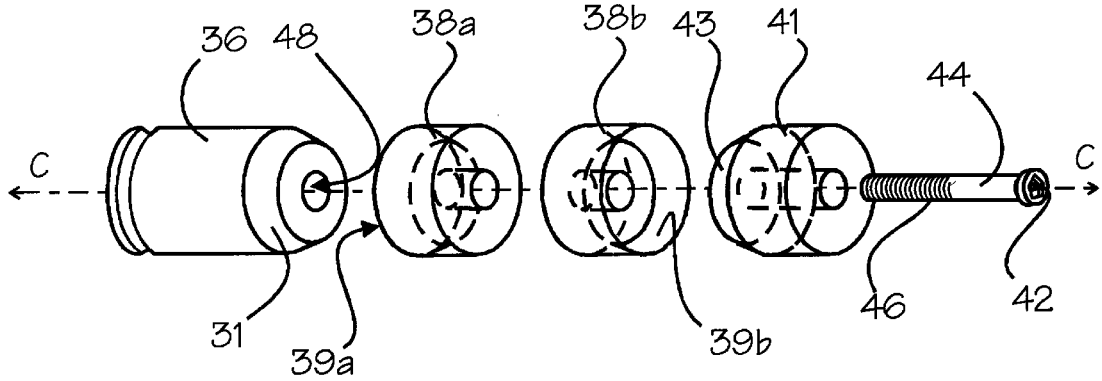
FIG. 15 is an exploded perspective view of another preferred embodiment of the present invention.
Figure 16:
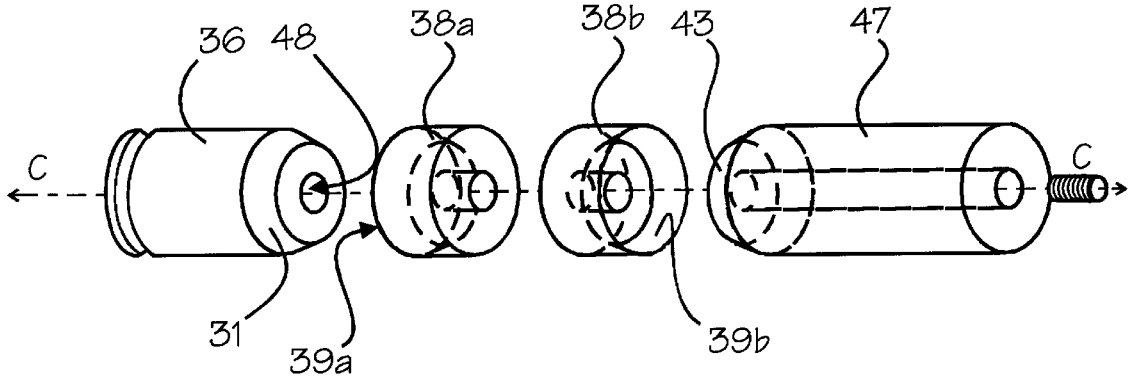
FIG. 16 is an exploded perspective view of yet another preferred embodiment of the present invention.

FIGS. 15 and 16 are perspective views of two further preferred embodiments of the present invention. Both improved embodiments incorporate a design that self-centers the expandable portions 38 along the center axis "C" of the lock. In each of these embodiments, the self-centering aspect is achieved by cooperating beveled features in adjoining elements.

In particular, the improved base 36 comprises a cone-shaped end 31. Adjacent to it in the assembled lock is a first expandable portion 38*a,* which is defined by a cone-shaped depression 39*a,* configured to accept the cone-shaped portion 31 therein.

Similarly, the alternative compression disc 41 (also known as the compression member 41) comprises a cone-shaped end 43. Adjacent to the compression disc 41 in the assembled lock is a second expandable portion 38*b*, which like the first, is defined by a cone-shaped depression 39*b*, configured to accept the cone-shaped portion 43 therein. The two expandable portions 38*a* and 38*b* combine to form an "expandable section". In this improved design, the expandable section will be expanded by turning the socket 42 to cause the compression shaft 44 to compress the alternative compression disc 41 into the expandable section.

Similar to the device of FIG. 15, the device of FIG. 16 comprises many of the same parts. The exception is the compression member 47, which is an elongated rod-like member having a cone-shaped end 43 to cooperate with the expandable portion 38*a*. The purpose of the elongated compression member 47 is to permit the lock to prevent a revolver from firing. It accomplishes this by insertion of the lock down the barrel of the revolver and into the chamber. The elongate compression member 47 will then extend into the barrel of the firearm. Once locked into place (by compressing the expandable portion(s) until they reach the walls of the chamber), the pistol's revolving chamber will be prevented from turning (by the lock), and there the user will be preventing from aligning a round up with the barrel and firing mechanisms.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A lock for firearms, said firearms comprising a chamber having inner walls, a recoiling slide and at least one extracting finger attached to said slide, said lock comprising:

a base engageable with at least one said extracting finger;

at least one expandable portion adjacent to said base, each said expandable portion being expandable to engage said walls to prevent said slide from recoiling; and a compression shaft in engagement with said base and said expandable portion to compress said expandable portion.

2. The lock of claim 1, wherein:

said lock is further comprised by at least one said expandable portion comprising an expandable section, said expandable section is further defined by a base end and an opposing tip end, said base end being adjacent to said base, and said lock further comprises a compression disc adjacent to said tip end and in cooperation with said compression shaft to compress said expandable portion.

3. The lock of claim 2, wherein said expandable section comprises pliable, elastic material.

4. The lock of claim 3, wherein said base further comprises a groove for engagement with said extracting finger.

5. The lock of claim 4, wherein:

said base further comprises a threaded tube for accepting said compression shaft, and said compression shaft further comprises a socket end adjacent to said compression disc, a threaded end opposite to said socket end and a threaded portion adjacent to said threaded end, said threaded portion configured to cooperate with said threaded tube.

6. The lock of claim 5, further comprising:

a cam hub attached to said base, and said compression shaft further comprises a follower portion for engagement with said cam hub to provide a compressed position wherein said expandable portion is in a compressed state, and a relaxed position wherein said expandable portion is in a relaxed state.

7. The lock of claim 6, further comprising a follower member attached to said compression shaft and cooperating with said cam hub.

8. The lock of claim 6, wherein said cam hub is further defined by an axial bore, at least one shallow notch and at least one deep notch, said notches configured to receive said follower member.

9. A lock for firearms, said firearms comprising a chamber having inner walls and a barrel defining a bore, said lock comprising:

a base insertible within said chamber said base further defines a cone-shaped end;

at least one expandable portion adjacent to said base, each said expandable portion being expandable to engage said walls to restrain said base from movement relative to said chamber said first expandable portion further defining a cone-shaped recess configured to cooperate with said cone-shaped end of said base, whereby pressing said first expandable portion towards said cone-shaped end will deform said first expandable portion in a direction generally perpendicular to said cone-shaped recess; and a compression shaft in engagement with said base and said expandable portion to compress said expandable portion.

10. The lock of claim 9, wherein said lock further comprises a compression member, said compression disc defining a cone-shaped end; and said second expandable portion defines a cone-shaped recess configured to cooperate with said cone-shaped end of said compression disc, whereby pressing said compression disc towards said second expandable portion will deform said second expandable portion in a direction generally perpendicular to said cone-shaped recess.

11. The lock of claim 10, wherein:

said first and second expandable portions each define flat ends opposite said cone-shaped recesses; and said first and second expandable portions are aligned with said flat ends adjacent one another.

12. The lock of claim 11, wherein said compression shaft compresses said compression disc into said second expandable portion.

13. The lock of claim 9, comprising a first and second said expandable portion, and wherein said first and second expandable portions comprise an expandable section.

14. A lock for firearms, said firearms comprising a chamber having inner walls and a barrel defining a bore, said lock comprising:

a base insertible within said chamber;

a compression member, said compression member defining a cone-shaped end;

a second expandable portion defining a cone-shaped recess configured to cooperate with said cone-shaped end of said compression member, whereby pressing said compression member towards said second expandable portion and said base will deform said second expandable portion in a direction generally perpendicular to said cone-shaped recess; and a compression shaft in engagement with said base and said second expandable portion to compress said second expandable portion.

* * * * *